US007717284B2

(12) United States Patent
Giusti

(10) Patent No.: US 7,717,284 B2
(45) Date of Patent: May 18, 2010

(54) FLIP TOP CAP

(75) Inventor: David C. Giusti, Sommerville, MA (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 652 days.

(21) Appl. No.: 11/178,048

(22) Filed: Jul. 8, 2005

(65) Prior Publication Data

US 2006/0024205 A1 Feb. 2, 2006

Related U.S. Application Data

(60) Provisional application No. 60/591,273, filed on Jul. 27, 2004.

(51) Int. Cl.
*B65D 51/16* (2006.01)
*B65D 51/18* (2006.01)
*B65D 41/00* (2006.01)

(52) U.S. Cl. ..... 220/254.3; 215/305; 220/259.1; 220/366.1

(58) Field of Classification Search ..... 220/254.3, 220/836, 839, 366.1, 259.1; 215/235, 305
See application file for complete search history.

(56) References Cited

U.S. PATENT DOCUMENTS 2,630,239 A * 3/1953 Paull et al. ..... 220/254.3
3,295,726 A 1/1967 Hanson
4,713,219 A 12/1987 Gerken et al.
5,139,165 A 8/1992 Hara
5,141,138 A * 8/1992 Odet et al. ..... 222/153.07
5,200,153 A 4/1993 Carr et al.
5,225,165 A * 7/1993 Perlman ..... 422/102
5,254,314 A 10/1993 Yu et al.
5,386,918 A * 2/1995 Neveras et al. ..... 215/235
5,398,837 A 3/1995 Degrassi
5,509,564 A * 4/1996 Knoop ..... 220/360
5,531,349 A 7/1996 Wojcik et al.
5,547,109 A * 8/1996 Robbins, III ..... 222/158
5,667,094 A 9/1997 Rapchak et al.
5,755,352 A 5/1998 Wojcik et al.
5,860,543 A 1/1999 Decelles
5,871,111 A 2/1999 Pfefferkorn et al.
5,884,793 A 3/1999 Wang
6,145,688 A 11/2000 Smith
6,170,719 B1 1/2001 Wilkinson et al.
6,234,334 B1 * 5/2001 Suarez ..... 215/237
6,283,298 B1 9/2001 Seidler
6,350,254 B1 2/2002 Wilkinson et al.
6,352,171 B2 3/2002 Leboucher
6,375,028 B1 4/2002 Smith
6,405,885 B1 * 6/2002 Elliott ..... 215/237
6,439,410 B1 8/2002 Dubach (Continued)

*Primary Examiner*—Anthony Stashick
*Assistant Examiner*—Niki M Eloshway
(74) *Attorney, Agent, or Firm*—Hoffmann & Baron, LLP

(57) ABSTRACT

A cap is provided for a laboratory vessel. The cap includes a lid that can be rotated relative to the laboratory vessel from a closed position to an open position. The lid includes at least one tab dimensioned and disposed for receiving manual digital pressure for opening and/or closing the lid. The tab is in an offset position to prevent a thumb or forefinger from passing over and in contact with the opening to the vessel. Additionally, the lid includes a shield inwardly from the tab for further preventing contact between a finger and the open top of the vessel.

8 Claims, 4 Drawing Sheets

U.S. PATENT DOCUMENTS

| | | | | |
|---|---|---|---|---|
| 6,841,132 | B2 | 1/2005 | Samsoondar | |
| 6,866,826 | B2 | 3/2005 | Moore et al. | |
| 6,890,488 | B2 | 5/2005 | Mathus et al. | |
| 6,932,942 | B2 | 8/2005 | Itoh | |
| 6,981,607 | B2 * | 1/2006 | Lown et al. | 220/254.3 |
| 7,007,830 | B2 * | 3/2006 | Parve et al. | 222/556 |
| 2003/0136753 | A1 * | 7/2003 | Biesecker et al. | 215/224 |
| 2003/0136783 | A1 | 7/2003 | Hatsumoto et al. | |
| 2004/0089627 | A1 | 5/2004 | Smith et al. | |
| 2005/0242105 | A1 * | 11/2005 | Homann | 220/840 |
| 2006/0000833 | A1 * | 1/2006 | Boots et al. | 220/254.3 |
| 2006/0013737 | A1 | 1/2006 | Giusti | |
| 2006/0091100 | A1 * | 5/2006 | Geho | 215/305 |
| 2006/0151416 | A1 * | 7/2006 | Hennemann et al. | 215/235 |
| 2007/0009390 | A1 | 1/2007 | Giusti | |

* cited by examiner

FLIP TOP CAP

CROSS-REFERENCE TO RELATED APPLICATION

This Application claims priority to U.S. Provisional Application No. 60/591,273, filed Jul. 27, 2004, the entire contents of which are incorporated by reference herein.

BACKGROUND OF THE INVENTION

1. Field of the Invention

The invention relates to a flip top cap for use with laboratory vessels, such as tubes.

2. Description of the Related Art

Many laboratory procedures require tissue cultures or cell cultures to be stored and/or cultivated in a vessel, such as a tube or a flask. The typical tube includes a cylindrical side wall, a closed bottom and an open top. The closed bottom often is conically generated. The size of the tube varies from one laboratory procedure to another, and tubes typically will define volumes from 15 mL to 50 mL. Flasks also have a side wall, a closed bottom and an open top. For simplicity, the following discussion will describe tubes, but pertains to other laboratory vessels as well.

Many laboratory procedures require the tissue or cell cultures in the tube to remain sterile. Thus, the tube typically is provided with a cap for sealing the open top of the tube. However, the cap must be removed periodically to access the tissue or cell cultures in the tube.

Many caps are formed separate from the tube and have a portion dimensioned for telescoping partly into the tube and sealing with the inner surface of the side wall adjacent the open top of the tube. These caps may be formed from an elastomer or other resilient material to ensure sealing with the tube. Other caps include a substantially rigid collar surrounding portions of the cap that telescope into the tube. The collar can be telescoped over the open top of the tube and provides a region that can be gripped conveniently for removing the cap from the tube.

Laboratory workers generally place the cap top-down on a laboratory work surface while they are accessing the interior of the tube with a pipette to obtain a sample of the cell or tissue culture in the tube. Thus, the side and bottom of the cap do not contact the potentially non-sterile work surface. The cap then is repositioned in sealing engagement with the open top of the tube after the cell or tissue culture has been accessed. These tube and cap combinations require the laboratory worker to use two hands to remove the cap. Additionally, these tube and cap combinations create the potential that the cap will be positioned improperly on the work surface, thereby creating the potential for contaminants being transferred from the work surface to the tissue or cell culture in the tube.

Some tubes have been manufactured with a flip cap to permit one-handed opening and to avoid the need to place any part of the cap on a laboratory work surface while the interior of the tube is being accessed by a pipette. These tube and cap assemblies typically include a body that is threaded or otherwise mounted to the open top of the tube. A cap is connected to the body by a hinge, such as a living hinge. A laboratory worker holds the tube between the forefingers and the palm of one hand. The thumb of the same hand then is urged against the cap to move the cap out of engagement with the body so that the cell or tissue culture in the tube can be accessed. These flip top caps provide certain handling efficiencies and avoid the need to place the cap on the work surface in the laboratory while the contents of the tube are being sampled.

However, prior art flip top caps require the user's thumb to pass directly over the open top of the tube. There is a high probability that the user's thumb will contact the open top of the tube while the cap is being rotated away from the open top of the tube. Contact of the thumb with the open top of the tube is likely to contaminate the tube and the tissue or cell cultures stored therein.

In view of the above, it is an object of the subject invention to provide a tissue culture vessel, such as a tube, that can be opened easily without significant risk of contamination to the contents of the vessel.

SUMMARY OF THE INVENTION

The invention is a cap for a laboratory vessel, such as a tube. The vessel includes an open top, and the cap includes a lid that is hingedly secured in proximity to the open top of the vessel. Thus, the lid can be rotated hingedly from a closed position where the top of the vessel is closed and an open position where the top of the vessel is open. The open position is angularly spaced from the closed position by at least 90° and preferably about 180°.

The lid of the cap may be joined to a body and the body may be mounted to the open top of the vessel. For example, the vessel may include an array of threads, and the body may include an array of mating threads for securely mounting the body to the vessel. The body and the lid may be joined unitarily to one another by a living hinge. The living hinge may be an over-center hinge that is biased towards a fully closed position and/or a fully opened position. Thus, the over-center hinge will assist complete opening and/or complete closing of the lid.

The cap preferably includes at least one tab, and most preferably two tabs extending outwardly from the lid. The tab preferably is offset from a line that passes perpendicular to the rotational axis of the hinge at a location centrally along the hinge. The offset positioning of the tabs offsets the thumb or forefinger of the user from the open top of the vessel, and hence reduces the possibility of contact with the open top of the vessel. Hence, the potential for contamination of cell or tissue cultures in the vessel is reduced. Some embodiments may have no tab and may have surface textures or configurations on the lid to facilitate opening.

The lid preferably includes a shield disposed to at least partly surround the open top of the vessel when the lid is in the closed position. The shield is at a side of the lid opposite the hinged connection and preferably extends along at least portions of the lid that have the tab. More particularly, the shield preferably is disposed inwardly from the tab, and hence between the tab and the vessel. Accordingly, the shield cooperates with the tab to prevent contact with the open top of the vessel as the lid is being opened by a thumb or forefinger. The shield also prevents contact with portions of the lid that seal the open top.

The lid may further include a skirt dimensioned to telescope into the open top of the vessel or into the open top of the body mounted to the vessel. The skirt is dimensioned for sealed engagement with the open top of the vessel or with the body to achieve sterile containment of cell or tissue cultures in the vessel. Outer circumferential portions of the skirt may include anti-splash features, such as notches. The notches or other such anti-splash features balance air pressure between the inside and the outside of the vessel during the initial stage of opening the lid, and hence reduce the possibility of spraying or splashing as the lid is opened. The shield and the tab are disposed to prevent inadvertent contact with the skirt while the lid is being opened.

BRIEF DESCRIPTIONS OF THE DRAWINGS

DETAILED DESCRIPTION

Figure 5:
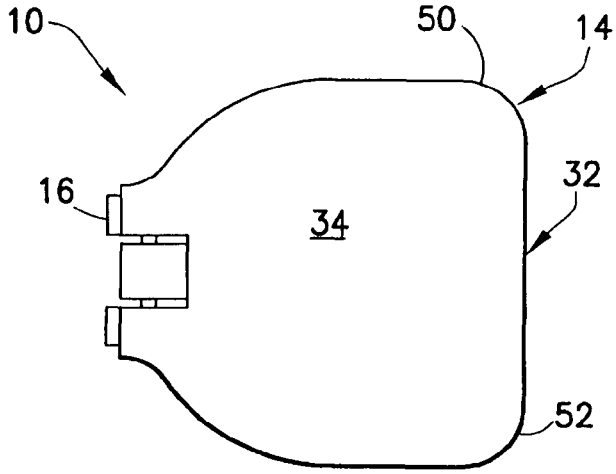
FIG. 5 is a top plan view of the cap in the closed position.
Figure 6:
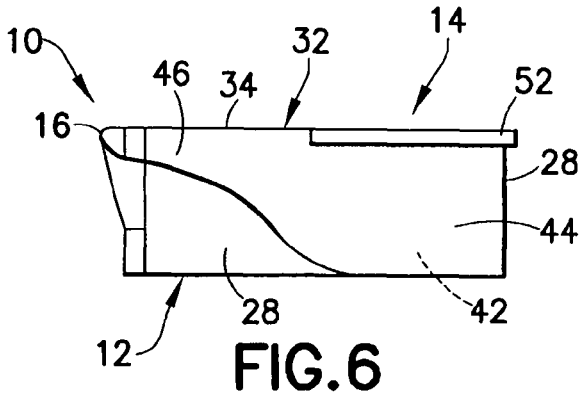
FIG. 6 is a side elevational view of the cap in the closed position.

A cap in accordance with the invention is identified generally by the numeral 10 in FIGS. 1-10. Cap 10 is molded unitarily from resin and includes a body 12 and a lid 14 that are joined unitarily by a living hinge 16. Hinge 16 enables lid 14 to be rotated approximately 180° between a fully open position, as shown in FIGS. 1-4, and a fully closed position, as shown in FIGS. 5 and 6. Additionally, hinge 16 has an over-center design configured to bias lid 14 through the final stages of rotation towards the open position of FIGS. 1-4 and towards the final stages of rotation towards the closed open position of FIGS. 5 and 6.

Body 12 includes a generally planar top wall 18 with a circular outer periphery 20 and a circular opening 22 concentric with outer periphery 20. A short cylindrical inner wall 24 extends down from top wall 18 concentrically with circular opening 22 in top wall 18. Thus, circular opening 22 and inner wall 24 define a short cylindrical sealing surface 26 facing inwardly on body 12.

Figure 1:
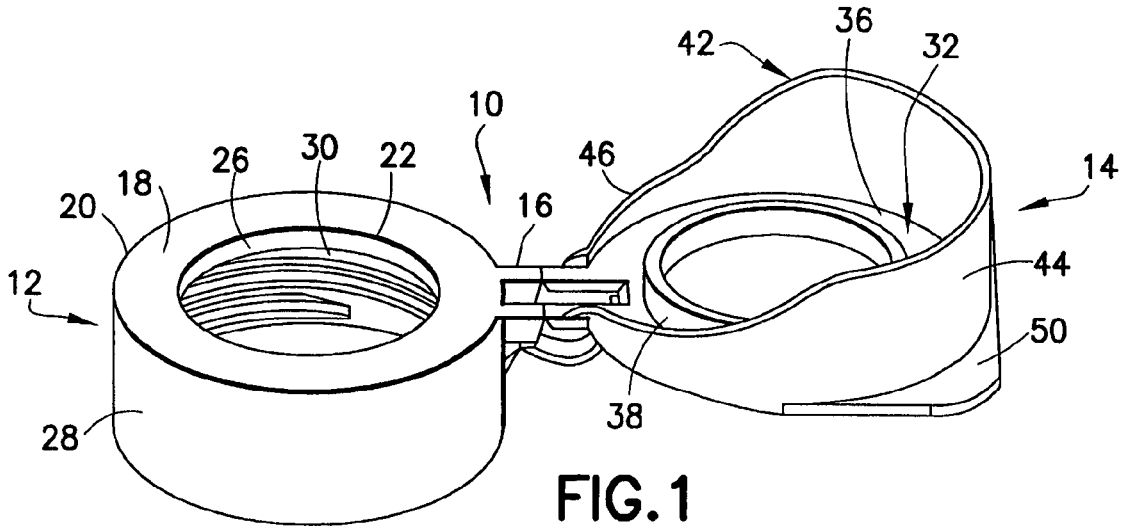
FIG. 1 is a perspective view of a cap in accordance with the invention.
Figure 3:
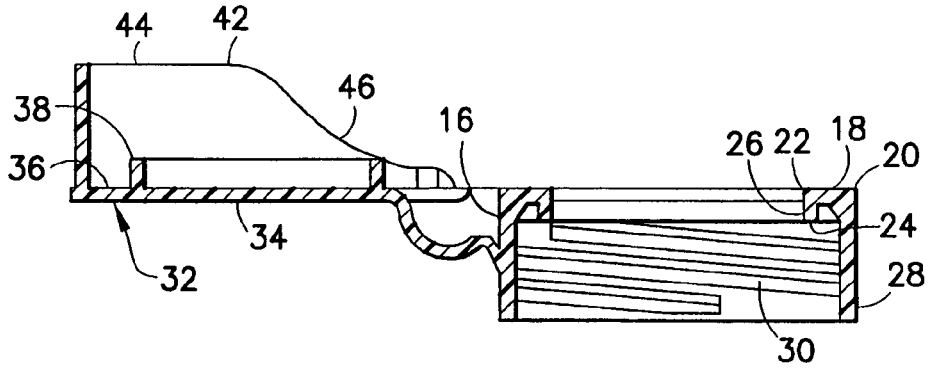
FIG. 3 is a cross-sectional view of the cap taken along line 3-3 in FIG. 2.
Figure 4:
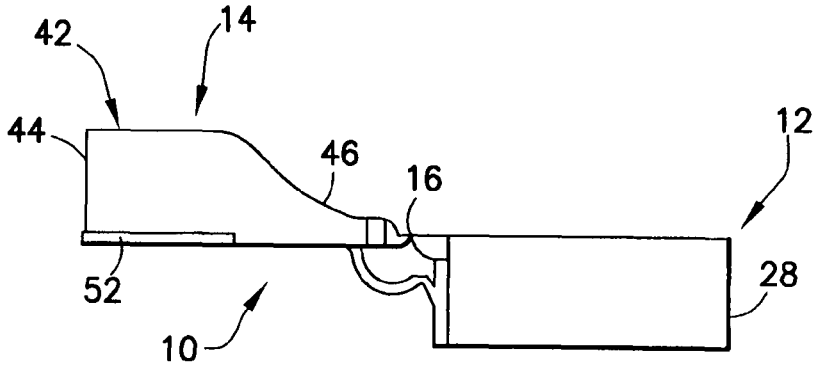
FIG. 4 is a side elevational view of the cap.

Body 12 further includes a substantially cylindrical outer wall 28 extending down from outer periphery 20 of top wall 18 and concentric with inner wall 24. Outer wall 28 has an array of internal threads 30 facing inwardly thereon, as shown in FIGS. 1 and 3.

Figure 2:
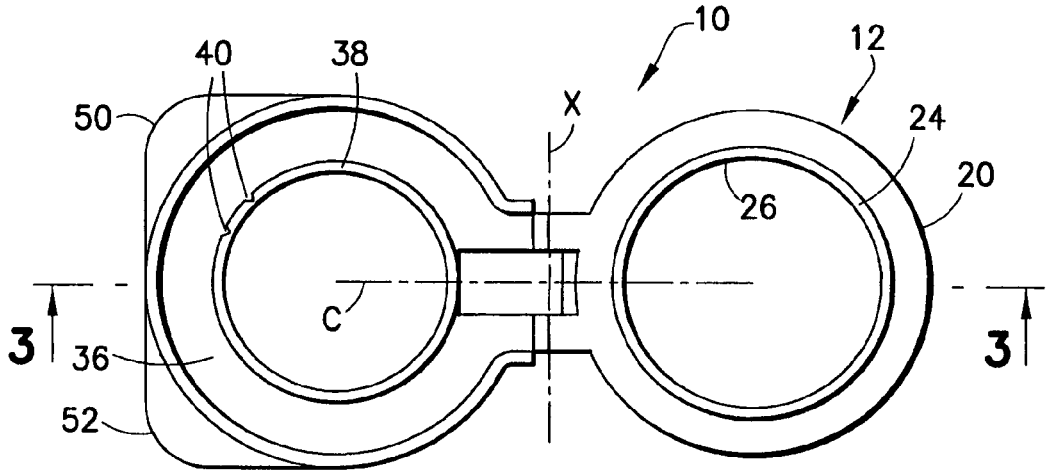
FIG. 2 is a top plan view of the cap shown in FIG. 1.

Lid 14 includes a substantially planar top wall 32 that is joined unitarily to top wall 18 of body 12 by hinge 16. Thus, top wall 32 of lid 14 can be rotated about a rotational axis "x" defined by hinge 16 and relative to top wall 18 of body 12. Top wall 32 of lid 14 has opposed inner and outer surfaces 34 and 36. Inner surface 36 faces up in the open position of lid 14 as shown in FIGS. 1-3. However, inner surface 36 of top wall 32 faces down and opposes top wall 18 of body 12 when lid 14 is in the closed position of FIGS. 5 and 6.

A substantially cylindrical skirt 38 extends perpendicularly from inner surface 36 of top wall 32 and is dimensioned for sealing engagement with sealing surface 26 of body 12 when lid 14 is rotated into the closed position of FIGS. 5 and 6. A plurality of anti-splash notches 40 are formed in the outer circumferential surface of skirt 38 along a side of skirt 38 substantially opposite hinge 16. Notches 40 extend from the edge of skirt 38 spaced from top wall 32 but terminate at locations spaced from inner surface 36 of top wall 32. Anti-splash notches 40 permit a flow of gas during early stages of movement of lid 14 from the closed position of FIGS. 5 and 6 towards the open position of FIGS. 1-4 to balance air pressure on opposite sides of cap 10 and to avoid a splashing or spraying of liquid that could otherwise occur with a very rapid change of air pressure. However, anti-splash notches 40 are not always required and may not be present on some embodiments.

Lid 14 further includes an outer wall 42 that projects perpendicularly from inner surface 36 of top wall 32 at a location spaced outwardly from skirt 38. Outer wall 42 is substantially cylindrically generated about a longitudinal axis that is perpendicular to and spaced from rotational axis "x" of hinge 16. Additionally, outer wall 42 defines an inside diameter that exceeds the outside diameter defined by top wall 18 and outer wall 28 of body 12. Thus, outer wall 42 of lid 14 can be telescoped partly over body 12. Outer wall 42 includes a shield 44 that extends through an arc on a side of outer wall 42 substantially opposite hinge 16. Shield 44 of outer wall 42 preferably extends through an arc of between about 135° and about 320°. Portions of shield 44 that extend beyond 180° preferably should have a reduced height to facilitate opening and closing. In the illustrated embodiment, shield 44 of outer wall 42 extends through an arc of approximately 180° at a maximum height. Outer wall 42 further includes short sections 46 that extend from opposite circumferential ends of shield 44 towards hinge 16. The height reduction achieved through short sections 46 of outer wall 42 permit lid 14 to be rotated efficiently from the open position of FIGS. 1-4 to the closed position of FIGS. 5 and 6 without interference with body 12. In the preferred embodiment, shield 44 of outer wall 42 defines a height of between approximately 0.4-0.7 inch, and preferably about 0.54 inch.

Lid 14 further includes tabs 50 and 52 that extend outwardly from shield 44 substantially in the plane defined by top wall 32 of lid 14. Tabs 50 and 52 are disposed at locations on lid 14 spaced circumferentially from hinge 16. More particularly, each tab 50, 52 extends from a side location spaced circumferentially approximately 90° from a center line "c" that passes perpendicularly through rotational axis "x" at the center of hinge 16. Additionally, tabs 50 and 52 extend towards a distal location on top wall 32 substantially diametrically opposite the intersection of center line "c" and rotational axis "x" of hinge 16.

Each tab 50 and 52 has a shape substantially conforming to an isosceles right triangle that has a rounded right angle corner and a concave hypotenuse conforming to the outer circumferential surface of shield 44. The maximum radial extent of each tab 50 and 52 is disposed at a position spaced approximately 135° from the intersection of center line "c" and rotational axis "x" of hinge 16. The maximum extent of tabs 50, 52 from shield 44 is sufficient to provide a secure and convenient engagement surface for a thumb or forefinger during opening of lid 14 relative to body 12. Preferably the maximum extent of tabs 50 and 52 is in a range of 0.2-0.4 inch. One or more tabs can be disposed at other locations on lid 14 and the tabs can take other configurations. For example, tabs 50 and 52 can be diametrically opposite and may extend normal to center line "c". Still further, lid 14 can be opened by structure or surface configurations other than tabs. For example, lid 14 can have external roughening, ribs, grooves, indentations or the like.

Cap 10 can be employed with a laboratory vessel, such as tube 60 illustrated in FIGS. 7-10. Tube 60 has a cylindrical side wall 62, a closed conically generated bottom wall 64 and an open top (not shown). Portions of side wall 62 adjacent the open top have an array of external threads dimensioned and configured for threaded engagement with internal threads 30 on body 12 of cap 10. Thus, outer wall 28 of body 12 surrounds portions of cylindrical side wall 62 of tube 60 adjacent the open top of tube 60. Additionally, top wall 18 of body 12 rests on the open top of tube 60 and inner wall 24 of body 12 telescopes into cylindrical side wall 62 at the open top of tube 60. Lid 14 generally is in the closed condition illustrated in FIGS. 7 and 8 for securely sealing the interior of tube 60 and maintaining sterility for the interior of tube 60 and any cell or tissue cultures stored therein. In this closed condition, inner surface 36 of top wall 32 of lid 14 engages against top wall 18 of body 10. Additionally, skirt 38 is telescoped into sealing engagement with sealing surface 26 defined by opening 22 in top wall 18 and inner wall 24.

The contents of tube 60 may have to be accessed periodically by a pipette or the like to either remove culture from tube 60 or to deposit additional growth medium into tube 60. For this purpose, a laboratory worker grips side wall 62 of tube 60 between the forefingers and palm of a hand so that the thumb of that hand faces upwardly toward cap 10. The thumb then is urged against tab 50 or 52 and lid 14 is pushed up and away from body 12. As a result, lid 14 begins to rotate about hinge 16 and out of engagement with body 12. Notches 40 move past sealing surface 26 of body 12 during the initial movement of lid 14 to balance pressure on opposite sides of cap 10 and to avoid splashing or spraying that could otherwise occur with a sudden change of pressure. The over-center design of hinge 16 initially will resist rotation of lid 14 from the closed position shown in FIGS. 7 and 8. However, the over-center design of hinge 16 then assists rotation beyond about 90°, and accelerates lid 14 into the fully open condition illustrated in FIGS. 9 and 10.

Tabs 50 and 52 are in offset positions relative to centerline "c" passing centrally through hinge 16 perpendicular to rotation axis "x". Hence, the thumb used to open lid 14 necessarily will be in an offset position and is not likely to pass directly over opening 22 in top wall 18 of body 12. Additionally, tabs 50 and 52 are spaced outwardly from shield 44. Accordingly, shield 44 will separate the thumb of the user from opening 22 in top wall 18 and from skirt 38 as the thumb moves for rotating lid 14 from the closed position of FIGS. 7 and 8 to the open position of FIGS. 9 and 10. Accordingly, the disposition of tabs 50 and 52 and the disposition of shield 44 cooperate to prevent digital contact with areas of body 12 near opening 22 and hence prevent contamination. Additionally, cap 10 remains securely connected to tube 60 in both the open and closed conditions of lid 14. Accordingly, there is no risk of a cap being placed improperly on a work surface while the contents of tube 60 are being accessed. Still further, cap 10 permits convenient one-handed opening and closing and allows the laboratory worker to use the other hand for manipulating a pipette or other access device.

Figure 7:
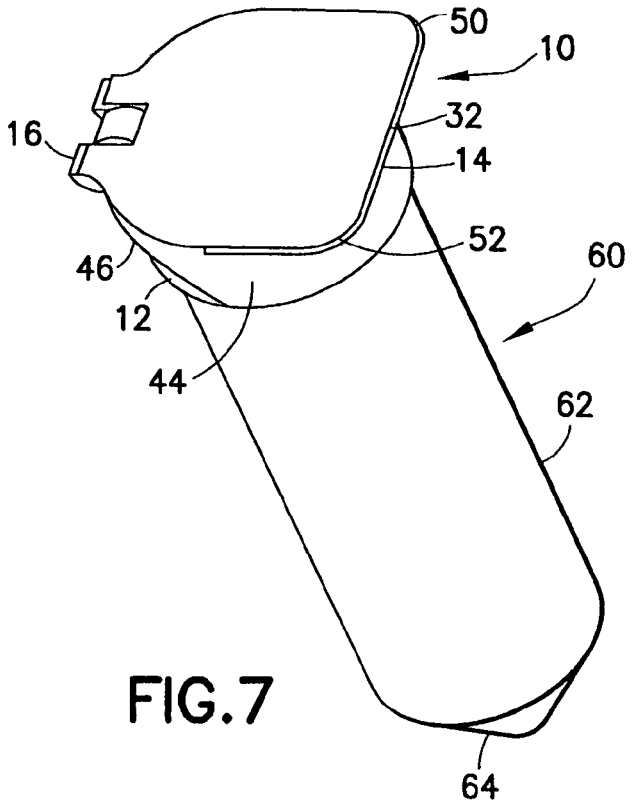
FIG. 7 is a perspective view of the closed cap mounted to a tube and showing the cap from the top side.
Figure 8:
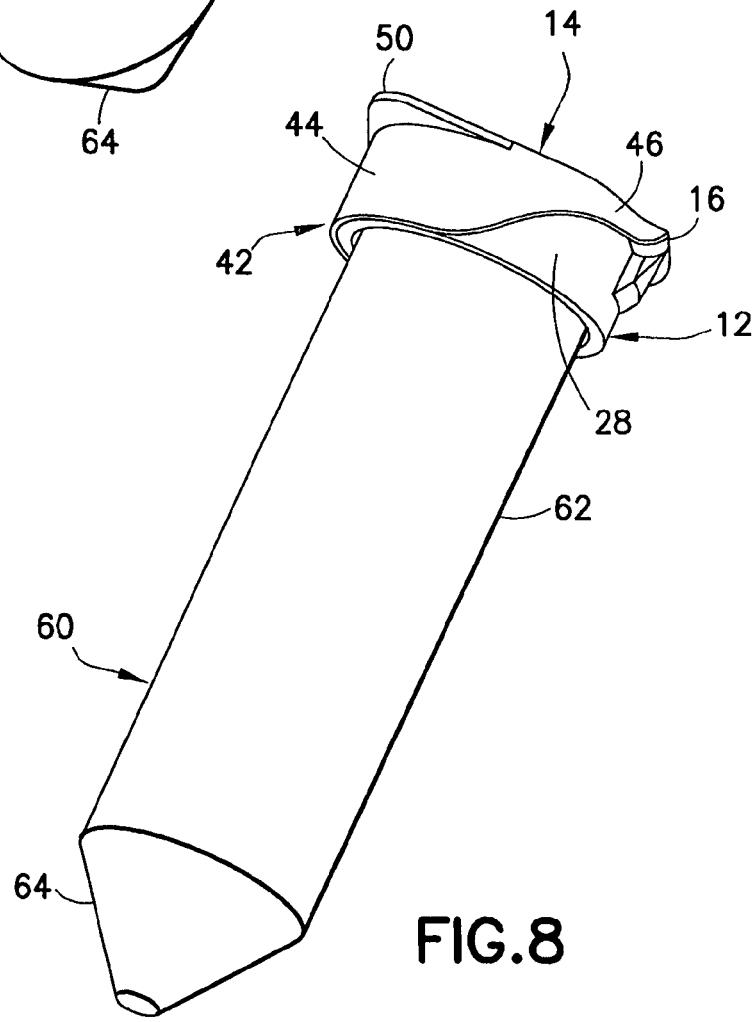
FIG. 8 is a perspective view of the closed cap mounted to a tube and showing the lower side of the cap.
Figure 9:
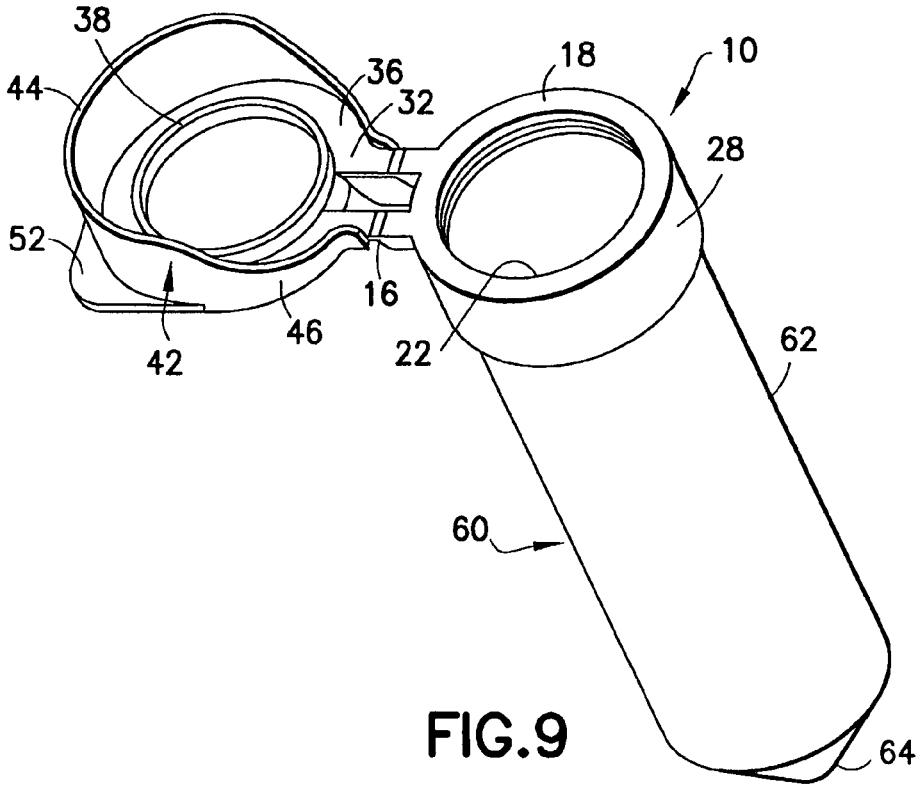
FIG. 9 is a first perspective view of the open cap mounted to the tube.
Figure 10:
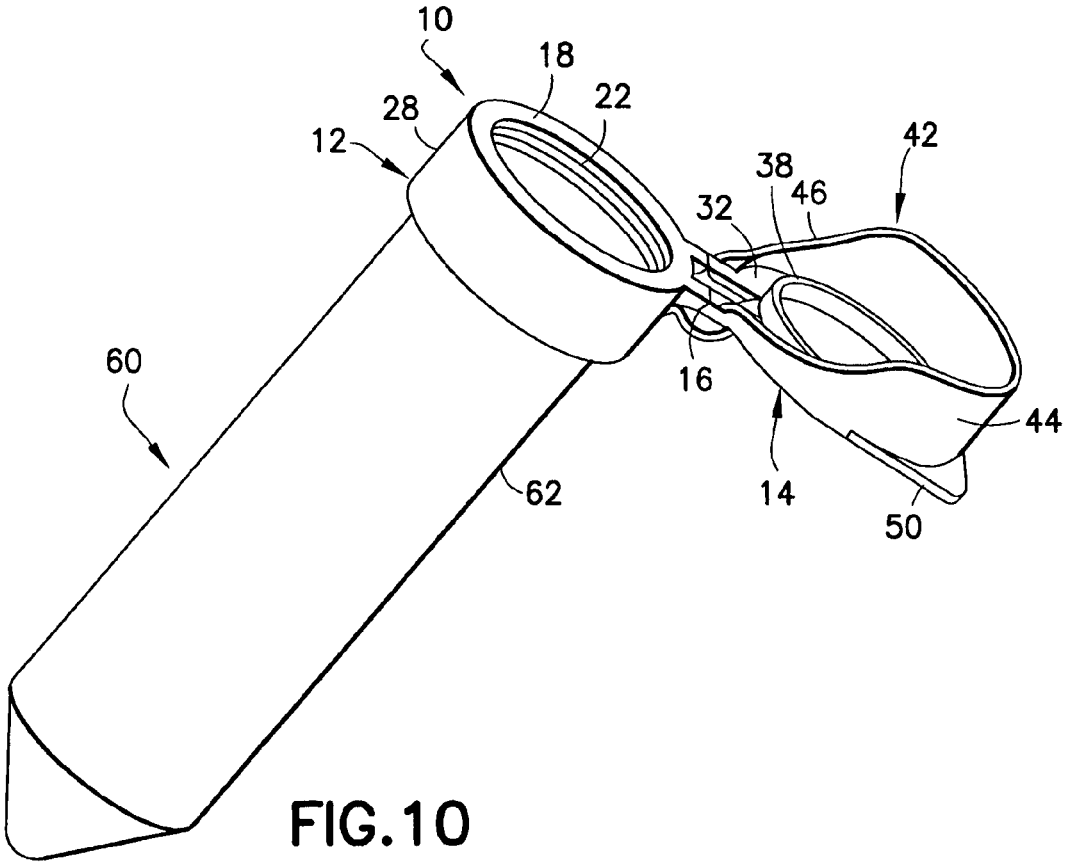
FIG. 10 is a second perspective view of the open cap mounted to the tube.

Lid 14 can be rotated from the open position in FIGS. 9 and 10 back to the closed position of FIGS. 7 and 8 after the interior of tube 60 is accessed. The shortening of outer wall 42 along sections 46 nearer hinge 16 enables lid 14 to be rotated into the closed position without interference with any part of body 12. Furthermore, the user inherently will engage portions of tabs 50 and 52 aligned with outer surface 34 of top wall 32 for moving lid 14 to the closed position of FIGS. 7 and 8. Hence, contamination with opening 22 is prevented during closing.

The invention has been described with respect to a preferred embodiment. However, changes can be made without departing from the scope of the invention defined by the appended claims. For example, the lid may be formed unitarily with the tube or other such vessel. This design option will avoid the need for providing a cap with a body that is hingedly attached to the tube or other vessel.

The lid 14 can be provided with only one of the tabs 50 and 52.

The tabs 50 and 52 can be disposed in an even more offset disposition and spaced further from the center line "c" passing perpendicularly through the rotational axis "x" defined by the hinge 16.

The hinge 16 need not be a living hinge and need not be of over-center design. For example, a hinge with plural parts snapped or otherwise connected can be provided.

What is claimed is:

1. A lid hingedly mounted in proximity to an open top of a laboratory vessel, the lid having a top wall configured for closing the open top in the vessel, first and second tabs projecting outwardly from said top wall for receiving digital pressure for hingedly rotating said lid relative to the vessel, a hinge for defining an axis of rotation for said lid, and an outer wall depending downwardly from said top wall located between said top wall and said tabs, a portion of said outer wall substantially aligned with said tabs defining a shield, said shield being dimensioned and configured with sufficient length extending downwardly from said top wall for preventing digital contact with portions of the vessel adjacent the open top during hinged rotation of said lid relative to the vessel, said shield terminating at an edge, a lower face extending from said edge, said lower face facing downwardly, said lower face being exposed with the lid closing the open top in the vessel, said tabs projecting outwardly from said outer wall to each define a free surface disposed transversely to said shield for receiving digital pressure, said first and second tabs each having a center at a position offset from, and not collinearly aligned with, a line passing through said hinge perpendicular to said axis of rotation, said centers of said first and second tabs being on opposite sides of said line and in alignment with said shield, wherein portions of said outer wall spaced from said shield and said hinge projecting a shorter distance from said top wall than portions of said outer wall that define said shield.

2. The lid of claim 1, wherein said top wall is substantially planar and wherein said tab is substantially coplanar with said top wail, said shield extending substantially perpendicularly from the substantially planar top wall.

3. The lid of claim 1, wherein the shield is substantially cylindrically generated and extends through an arc of at least approximately 180° at a location on said lid substantially opposite said hinge.

4. The lid of claim 1, further comprising an inner wall dimensioned for telescoping into said vessel for sealing said vessel, said shield being between said tab and said inner wall of said lid.

5. The lid of claim 4, wherein outer surface regions of said inner wall are formed with notches for equalizing pressure during an early stage of opening said lid to avoid generating splashes during opening of said lid.

6. The lid of claim 1, wherein said shield being substantially symmetrical with a line passing perpendicularly through said axis of rotation.

7. The lid of claim 6, wherein said shield is substantially cylindrically generated about an axis aligned substantially perpendicular to said axis of rotation.

8. The lid of claim 1, wherein said outer wall is configured for telescoped engagement over said open top of said vessel.

* * * * *